United States Patent [19]

Kotlyarevsky et al.

[11] 4,368,343

[45] Jan. 11, 1983

[54] PROCESS FOR PRODUCING HIGH-VACUUM OILS

[76] Inventors: Izrail L. Kotlyarevsky, ulitsa Zhemchuzhnaya, 10, kv. 3; Ninel I. Myakina, ulitsa Tereshkovoi, 8, kv. 25; Mikhail A. Kamkha, ulitsa Lenina, 18, kv. 67; Ivan M. Ikryanov, ulitsa Rossiiskaya, 17, kv. 87; Svetlana A. Glyadinskaya, ulitsa Shljuzovaya, 12, kv. 48, all of Novosibirsk, U.S.S.R.

[21] Appl. No.: 188,546

[22] Filed: Sep. 18, 1980

[51] Int. Cl.[3] ..... C07C 2/66; C07C 2/70

[52] U.S. Cl. ..... 585/456; 585/459

[58] Field of Search ..... 584/459, 456

[56] References Cited

U.S. PATENT DOCUMENTS

| | | | |
|---|---|---|---|
| 1,815,022 | 7/1931 | Davis | 585/459 X |
| 1,878,262 | 9/1932 | Chapell | 585/459 X |
| 2,837,724 | 6/1958 | Cook | 585/459 X |
| 3,444,255 | 5/1969 | Hiller et al. | 585/459 |

FOREIGN PATENT DOCUMENTS

| | | | |
|---|---|---|---|
| 665008 | 1/1952 | United Kingdom | 585/459 |

OTHER PUBLICATIONS

Adams et al., "Organic Reactions", vol. III, pp. 53–57, (1956).

*Primary Examiner*—Robert V. Hines
*Attorney, Agent, or Firm*—Lilling & Greenspan

[57] ABSTRACT

A process for producing high-vacuum oils comprises alkylation of condensed and non-condensed aromatic hydrocarbons by means of secondary normal alkylchlorides containing 8 to 12 carbon atoms or mixtures of said chlorides. The alkylchlorides are employed in a molar ratio to the condensed or non-condensed aromatic hydrocarbons of from 2.5:1 to 5:1. The alkylation reaction is conducted at a temperature within the range of from 20° to 100° C. in the presence of from 2 to 15 mol. % of aluminum chloride based on the amount of the employed alkylchlorides until the evolution of hydrogen chloride ceases, whereafter the catalyst is separated from the resulting alkylate. The alkylate is subjected to a vacuum fractionation and the desired fraction is collected which has a boiling temperature within the range of from 220° to 250° C./0.2–0.3 mm Hg, while the preceding fraction is recycled to alkylation stage.

5 Claims, No Drawings

PROCESS FOR PRODUCING HIGH-VACUUM OILS

The present invention relates to vacuum engineering and, more specifically, to methods, of producing high-vacuum oils employed as a working medium in super-high vacuum diffusion pumps.

FIELD OF THE INVENTION

A super-high vacuum of the order of $10^{-8}$–$10^{-9}$ mmHg is widely employed in modern industry, especially in electronics and nuclear engineering. To obtain such a vacuum, diffusion pumps are used with inorganic and organic liquids serving as the working medium in the pumps.

BACKGROUND OF THE INVENTION

These working liquids should satisfy four basic requirements: a low proper vapor tension, a high thermo-oxidation stability, relatively low viscosity at a temperature of 10°–20° C. and a high ultimate vacuum produced, namely $2\text{–}5\times10^{-8}$ mm Hg in unbaked systems without nitrogen traps and $2\text{–}5\times10^{-9}$ mm Hg in baked systems without nitrogen traps.

Known in the art are a number of working liquids possessing the above-mentioned properties. The best among them are allmeta-pentaphenyl ether (Convalex) and silicon oils.

These oils, however, feature a series of essential disadvantages. Thus, allmeta-pentaphenyl ether crystallizes at a temperature of 38° C. It is toxic and forms, after long-term operation, solid difficultly removable scaling on the inner surfaces of pumps and piping, thus impairing performance of vacuum units.

A common disadvantage of the prior art oils resides in the complicated process for their manufacture, and, correspondingly, a high production cost.

Known in the art is a process for producing a high-vacuum oil by way of alkylation of naphthalene with individual higher α-olefins containing 20 to 24 carbon atoms per molecule. The process is conducted at an elevated temperature in the presence of acid-type clay as a catalyst. These monoalkylnaphthalenes provide for a super-high vacuum when used in diffusion pumps of about $2.8\text{–}4.8\times10^{-9}$ mm Hg in heated systems (cf. U.S. Pat. No. 3,563,073; Cl.C 07 C 15/24; patented 1971).

However, difficulties associated with the production of individual higher alpha-olefins does not enable wide commercial implementation of this process and, consequently, a super-high-vacuum oil produced by alkylation of napthalene with individual higher alpha-olefins is substantially unavailable for industrial applications.

Furthermore, upon alkylation of naphthalene with olefins, oligomerization of the latter occurs at a considerable rate thus causing contamination of the desired product with dimers and trimers of olefins and, hence, strongly impairing the oils performance.

Also known in the art is a process for the production of a high-vacuum oil by way of alkylation of naphthalene with olefins formed upon dehydration of higher alcohols produced by hydrogenation of sperm oil. Vacuum oil is produced by alkylation of naphthalene with said olefins at a temperature within the range of from 20° to 100° C. in the presence of a complex catalyst $2BF_3.H_3PO_4$. The alkylation product comprises a mixture of higher monoalkylnaphthalenes which after purification ensure a vacuum of $2.10^{-9}$ mm Hg in diffusion pumps of heated systems. (cf. USSR Inventor's Certificate No. 544,644, cl. C07c$^3$, published 1977). Nevertheless, due to a sharp decrease of sperm whales this source of the starting raw material has become inaccessible and the above-described high-vacuum oil is not available in large-scale commercial production.

It should be also noted that, though oligomerization of olefins on the catalyst $2BF_3.H_3PO_4$ occurs to substantially lower extent than with other catalysts, the desired product is still contaminated with oligomers and its purification therefrom under commercial production conditions is associated with substantial difficulties.

BRIEF SUMMARY OF THE INVENTION

It is an object of the present invention to provide an alkylation agent which makes it possible to enlarge the range of starting raw materials for the manufacture of high-vacuum oils, increase the yield and improve the purity of the desired product, as well as to improve its operational characteristics.

This object is accomplished by a process for producing high-vacuum oils by way of alkylating of condensed and non-condensed aromatic hydrocarbons by means of normal secondary alkylchlorides containing 8 to 12 carbon atoms or mixtures thereof. These alkylchlorides and condensed and non-condensed aromatic hydrocarbons are employed in a molar ratio therebetween of from 2.5:1 to 5:1. The alkylation reaction is conducted at a temperature within the range of from 20° to 100° C. in the presence of 2 to 15 mol.% of aluminum chloride based on the amount of the alkylchlorides employed, until the evolution of hydrogen chloride ceases. Thereafter the catalyst is separated from the alkylate resulting from the reaction. The alkylate is subjected to a vacuum fractionation to collect the desired fraction having a boiling temperature within the range of from 220° to 250° C./0.2–0.3 mm Hg and the preceding fraction is recycled to the alkylation stage.

In order to increase the desired product yield, the fraction with a boiling range of from 170° to 220° C./0.2–0.3 mm Hg is recycled to the alkylation reaction. To increase yield and purity of the desired product, it is desirable to use naphthalene or biphenyl as the starting feedstock.

The high-vacuum oils produced by the process according to the present invention involve a mixture of di-, tri- and tetralkylnaphthalenes with 8 to 12 carbon atoms in every hydrocarbon chain and ensure vacuum of $3.10^{-8}$ mm Hg in unbaked systems without nitrogen traps and $2\text{–}5\times10^{-9}$ mm Hg in baked systems without nitrogen traps.

High-vacuum oils produced by the process according to the present invention feature certain advantages over the prior art: one of the advantages resides in availability and low cost of the starting materials due to the use, as the raw mixtures, of alkylchlorides with different molecular weights ($C_8$ to $C_{12}$). Alkylchlorides, in turn, can be produced in different methods such as chlorination of kerosene or, most preferably, by the addition of hydrogen chloride to α-olefins containing 8 to 12 carbon atoms produced on a large commercial scale, which are rather inexpensive and readily-available.

Furthermore, high-vacuum oils produced by the process of the present invention possess a low congelation temperature and a relatively high flowability at room temperature and a low proper vapor tension—$10^{-10}$ mm Hg.

DETAILED DESCRIPTION OF THE INVENTION

The process according to the present invention is effected in the following manner.

To a condensed or a non-condensed aromatic hydrocarbon there are added 2–15 mol.% of aluminum chloride based on the amount of alkylchlorides and then, under stirring at a temperature of from 20° to 30° C., there are added alkylchlorides containing 8 to 12 carbon atoms or a mixture of these alkylchlorides for a period of two hours. The alkylchlorides and hydrocarbons are taken in a molar ratio of from 2.5:1 to 5:1.

After the addition of the total amount of the alkylchlorides, the mixture is heated to a temperature within the range of from 60° to 100° C. for one hour. The reaction completion is detected by the stoppage of hydrogen chloride evolution. At a temperature of from 50° to 60° C. the alkylation products are separated from the liquid complex of aluminum chloride insoluble therein. Afterwards, the alkylation products are subjected to vacuum distillation at a temperature of from 0.1 to 0.5 mm Hg to recover, as the desired product, the fraction with a boiling range of from 220° to 250° C./0.2–0.3 mm Hg.

The yield of the desired product is 25 to 60% by weight. The best yield of the desired product of 50 to 60% by weight is ensured owing to the use of naphthalene and biphenyl in the alkylation reaction. The resulting high-vacuum oils have an iodine number within the range of from 0.6 to 1. This low iodine value points out the desired product purity and ensures a long-time operation. The preceding fraction comprises a mixture of mono- and dialkylnaphthalenes. This mixture may be used either as a vacuum oil for producing a vacuum of the order of from $10^{-5}$ to $10^{-6}$ mm Hg, or additionally alkylated to the desired product. Therefore, the yield of the desired product may be increased to 75–80% by weight.

The bottoms comprise a viscous liquid with a light-brown to dark brown color consisting of a mixture of polyalkylnaphthalenes or polyalkylbiphenyls with a boiling temperature above 250° C./0.2–0.3 mm Hg.

The bottoms per se can be used in different industries. Therefore, the process for the production of vacuum oils according to the present invention is substantially waste-free.

To produce high-vacuum oils with the best properties, it is advisable to make use of naphthalene as the condensed aromatic hydrocarbon, while as the non-condensed aromatic hydrocarbon use should be made of diphenyl.

Experiments have shown that the amount of $AlCl_3$ necessary for the production of high-quality products depends on the iodine number of the alkylchlorides employed. With high quality alkylchlorides (defined by their iodine number below 1), the amount of aluminum chloride may be reduced by 2–3 times, thus substantially lowering the quantity of production wastes.

The best results are obtained where alkylchlorides having an iodine number of not more than 1 are employed. It has been experimentally found that the best quality high-vacuum oil according to the present invention is obtained with the use of alkylchlorides produced by the addition of hydrogen chloride to α-olefins prepared by the Ziegler-Natta method, for example, α-olefins available from Mitsubishi Co. (Japan) or Gulf Oil (U.S.A.).

The advantage of using alkylchlorides formed upon the addition of hydrogen chloride to olefins is that hydrogen chloride evolving during alkylation can be used directly without purification for the synthesis of alkylchlorides by way of hydrochlorination of the next portion of olefins.

Therefore, hydrogen chloride is utilized in a closed production cycle.

For a better understanding of the present invention the following specific Examples are given hereinbelow by way of illustration.

EXAMPLE 1

Into a 100 l glass reactor (available from "Simax", Czechoslovakia) provided with a stirrer, coil and a pipe for the removal of the evolving hydrogen chloride there are charged 12.8 kg of naphthalene (140 moles), 1.2 kg (9 moles) of aluminum chloride and alkylchlorides are gradually added thereto under stirring. The reaction mass temperature is 25° C. The evolving hydrogen chloride is used directly in the reaction of hydrochlorination of olefins. The addition of alkylchlorides is conducted for 1 hour 40 minutes. Added altogether are 56 kg (240 moles) of alkylchlorides including the following alkylchlorides with the content of carbon atoms, in percent by weight, as specified hereinbelow:

| | | |
|---|---|---|
| $C_8$ | 3 | The average molecular weight |
| $C_9$ | 6 | assumed for the calculations |
| $C_{10}$ | 13 | is 200. |
| $C_{11}$ | 40 | (chlorine atom is in the second |
| $C_{12}$ | 23 | position of the molecular chain). |

Furthermore, the alkylchlorides contain 15% by weight of alkanes which do not take part in the reaction. The content of the alkylchlorides to naphthalene (molar) equal to 2.68 is calculated with the account of the weight of alkanes (the weight of alkanes is substracted from the total weight of the alkylchlorides charged into the reactor).

After adding the total amount of the alkylchlorides, the reaction mixture is heated to a temperature of 100° C. for one hour. In so doing, the evolution of hydrogen chloride is completely stopped.

Then the reaction mixture is allowed to stand for 40 minutes at a temperature within the range of from 80° to 50° C. (temperature slowly decreases due to natural cooling).

The mixture of the resulting alkylnaphthalenes is separated from the complex of aluminum chloride with alkylchlorides. To completely remove the complex of aluminium chloride with the alkylchlorides, the mixture of alkylnaphthalenes is stirred with 3 kg of silica gel at a temperature of from 50° to 60° C. and silica gel is then separated by centrifugation.

Alkanes are separated from the reaction product by distillation under a residual pressure of 12 mm Hg.

The thus-treated alkylnaphthalenes are subjected to vacuum fractionation under a vacuum of from 0.3 to 0.5 mm Hg into three fractions which are collected:

Fraction I with a boiling temperature of up to 170° C./0.3–0.5 mm Hg;

Fraction II with a boiling range of from 170° to 220° C./0.3 mm Hg;

Fraction III—a desired product with the boiling temperature within the range of from 220° to 250° C./0.3 mm Hg.

The yield of each fraction is as follows:

| | |
|---|---|
| Fraction I | 4 kg; |
| Fraction II | 7 kg; |
| Fraction III | 29 kg; |
| Bottoms | 8 kg. |

The yield is calculated taking into account the proper weight of the alkylchlorides (weight of alkanes incorporated in alkylchlorides is subtracted from the total weight of the alkylchlorides introduced into the reaction).

Fraction II comprising mono- and di-alkylnaphthalenes is collected from several operations and additionally alkylated.

The tests of vacuum performance of the resulting desired product show that when used in diffusion pumps the resulting vacuum oil ensures the following order of vacuum without the use of nitrogen traps:

| | |
|---|---|
| (a) in unbaked systems | $3 \times 10^{-8}$ mm Hg; |
| (b) in baked systems | $3 \times 10^{-9}$ mm Hg. |

EXAMPLE 2

Into a reactor similar to that described hereinabove there are charged 41 kg of the combined fraction II after six alkylation operations. 0.7 kg of aluminum chloride are added thereto. The reaction mixture is heated to a temperature of 30° C. and 27 kg of alkylchlorides are added thereto while stirring uniformly within a time period of one hour.

After adding the total amount of the alkylchlorides the mixture is heated to a temperature of 80° C. under continuous stirring for one hour. Afterwards, the mixture is treated as described hereinbefore.

The fraction with the boiling range of from 220° to 250° C. is collected during vacuum fractionation. The desired product yield is 43 kg (70% by weight). The yield is calculated in a manner similar to that described hereinabove.

The total yield of the desired product taking into account the post-alkylated product comprises 65% by weight. The iodine number is 0.6 to 1.

EXAMPLE 3

Into a three-neck glass flask provided with a stirrer, dropping funnel and gas-outlet tube there are placed 56 g of naphthalene, 40 ml of decane and 3 g of aluminum chloride.

2-Chlorodecane is uniformly added from the dropping funnel at a temperature of 20° C. with stirring. A total of 204 g of 2-chlorodecane are added.

After the addition of the entire amount of 2-chlorodecane, the mixture is heated for 40 minutes to a temperature of 60° C.

Then the reaction mixture is treated in a manner similar to that described in Example 1 hereinabove.

The following fractions are collected in a vacuum fractionation under a vacuum of 0.3 to 0.5 mm Hg:

Fraction I with a boiling point of up to 170° C./0.3–0.5 mm Hg;

Fraction II with a boiling range of 170°–230° C./0.3 mm Hg;

Fraction III with a boiling range of 230°–250° C./0.3 mm Hg;

Bottoms with a boiling point above 250° C./0.3 mm Hg.

The yield of the fractions is as follows:

| | |
|---|---|
| Fraction I | 8 g; |
| Fraction II | 26 g; |
| Fraction III | 169 g; |
| Bottoms | 18 g. |

The yield of fraction III—the desired product—is 75% by weight.

According to PMR-spectroscopy data, the number of alkyl groups per one molecule of naphthalene in fraction III is equal to 2.4.

Vacuum characteristics of the resulting desired product are similar to those of the vacuum oil produced in Example 1.

EXAMPLE 4

Into a three-neck flask provided with a stirrer, dropping funnel and gas-vent pipe there are charged 123 g (0.8 mole) of diphenyl, and 16 g (0.12 mole) of aluminum chloride.

The reaction mixture is stirred at a temperature of 20° C. for two hours while adding 420 g (2.1 moles) of alkylchlorides (having a composition similar to that of Example 1 hereinabove). After the addition of the entire amount of the chloralkanes the mixture is heated under continuous stirring for one hour at a temperature of 80° C.

The reaction mixture is then subjected to a treatment following the procedure of Example 1, followed by distillation.

The first distilled-off products under vacuum are alkanes. A vacuum of 12 mm Hg is ensured by means of a water-jet pump. The residue is distilled in a vacuum of 0.3–0.5 mm Hg. The following fractions are thus obtained:

Fraction I with a boiling point of up to 180° C./0.3–0.5 mm Hg;

Fraction II with a boiling range of 180°–220° C./0.3 mm Hg;

Fraction III with a boiling point of 220°–250° C./0.3 mm Hg;

Bottoms with a boiling point of above 250° C./0.3 mm Hg.

The yield of the thus-obtained fractions is as follows:

| | |
|---|---|
| Fraction I | 35 g; |
| Fraction II | 90 g; |
| Fraction III | 215 g; |
| Bottoms | 50 g. |

The yield of Fraction III—the desired product—is equal to 53% by weight. The iodine number is 0.6–1.

Tests of vacuum properties of the desired product show that upon its use in diffusion pumps the following vacuum is obtained without using nitrogen traps:

| | |
|---|---|
| (a) in non-heated systems | $2 \cdot 10^{-7}$ mm Hg; |
| (b) in heated systems | $5 \cdot 10^{-9}$ mm Hg; |

with the use of nitrogen traps in a heated system the attained vacuum is $7.10^{-10}$ mm Hg.

EXAMPLE 5

Alkylation of 0.6 mole of naphthalene with 3 mole of 2-chloroctane is conducted under the conditions specified in Example 1 hereinbefore. For the alkylation use is made of 75.5 g of naphthalene, 438 g of 2-chloroctane and (1.3 g) of aluminum chloride. The reaction results in a mixture of octylnaphthalenes having an average molecular weight of 550. The yield of the desired product having a boiling temperature of from 220° to 250° C./0.3 mm Hg is 250 g (65% by weight). The iodine number is 0.6.

This condensation product consists of a naphthalene nucleus having, as substituents, 3.75 octyl radicals on the average, i.e. it consists mainly of tetraoctylnaphthalene with contaminating amounts of trioctylnaphthalene. When used in diffusion pumps, the product ensures the vacuum of $10^{-8}$ mm Hg in unbaked systems without nitrogen traps.

EXAMPLE 6

Into a reaction vessel provided with a stirrer there are charged 123 g (0.8 mole) of biphenyl, and 25 g (0.16 mole) of aluminum chloride.

At a temperature of 20° to 25° C. under continuous stirring there are uniformly added for 45 minutes, 420 g of alkylchlorides with the composition specified in Example 1. To complete the reaction, the mixture is heated to a temperature of 80° C. for 30 minutes. After cooling and settling for 45 minutes the reaction mixture is separated from the lower layer of the complex of aluminum chloride with alkylchlorides and passed through a thin layer of silica gel.

Under a vacuum of 10–12 mm Hg, alkanes are distilled-off from the reaction mixture, while the alkylation products are fractionated under a vacuum of 0.2–0.3 mm Hg.

The following fractions are collected in the fractionation:

Fraction I with a boiling point of up to 190° C./0.3 mm Hg;

Fraction II with a boiling range of 190°–220° C./0.3 mm Hg;

Fraction III with a boiling range of 220°–230° C./0.3 mm Hg;

Fraction IV with a boiling range of 230°–250° C./0.3 mm Hg.

The yield of the fraction is the following:

| | |
|---|---|
| Fraction I | 35 g; |
| Fraction II | 65 g; |
| Fraction III | 87 g; |
| Fraction IV | 92 g; |
| Bottoms | 50 g |

Fractions III and IV comprise the desired product with an iodine number of 0.5. This is a colorless viscous liquid which when used in diffusion pumps ensures a vacuum of $2.10^{-7}$ mm Hg in unbaked systems. In baked systems it ensures a vacuum of $5.10^{-9}$ mm Hg without nitrogen traps and with nitrogen traps $-7.10^{-10}$ mm Hg. The congelation point is −41° C.

EXAMPLE 7

In a flask provided with a stirrer there is effected condensation of 134 g (0.8 mole) of diphenylmethane with 400 g (1.8 mole) of alkylchlorides of the composition of Example 1 in the presence of 20 g (0.14 mole) of aluminum chloride under the conditions of Example 1. After treatment of the reaction mixture described in Example 1 it is fractionated under a vacuum of 0.2–0.3 mm Hg.

As a result of fractionation, the following fractions are collected:

Fraction I with a boiling point of up to 180° C./0.3 mm Hg;

Fraction II with a boiling range of from 180° to 220° C./0.3 mm Hg;

Fraction III with a boiling range of 220°–250° C./0.3 mm Hg;

The yield of the fractions is the following:

| | |
|---|---|
| Fraction I | 86 g; |
| Fraction II | 80 g; |
| Fraction III | 76 g; |
| Bottoms | 35 g. |

Fraction III comprises a high-vacuum oil with an iodine number of 1.3. When used in diffusion pumps, this oil ensures a vacuum of $10^{-7}$ mm Hg in unbaked systems which, as a rule, corresponds to a vacuum of $10^{-9}$ mm Hg in baked systems. The congelation temperature is −46° C.

EXAMPLE 8

In a flask provided with a stirrer there is effected condensation of 46.8 g (0.6 mole) of benzene with 460 g (2.2 moles) of alkylchlorides prepared from alpha-olefins with a boiling temperature within the range of from 210° to 240° C. in the presence of 20 g of aluminum chloride. The reaction is carried out as described in Example 1 hereinbefore.

The resulting alkylbenzenes are fractionated under a vacuum of from 0.2 to 0.5 mm Hg. As a result, the following fractions are obtained:

Fraction I with a boiling point of from 140° to 195° C./0.2–0.5 mm Hg;

Fraction II with a boiling range of 195°–215° C./0.3 mm Hg;

Fraction III with a boiling range of 220°–250° C./0.3 mm Hg.

The fractions are obtained in the following yield:

| | |
|---|---|
| Fraction I | 65 g; |
| Fraction II | 47 g; |
| Fraction III | 66 g. |

Fraction III is the desired product. When used in diffusion pumps as the working fluid it ensures a vacuum of $3.10^{-8}$ in a heated system, without nitrogen traps; with the use of nitrogen traps vacuum is of $7.10^{-9}$ mm Hg. The congelation point of the high-vacuum oil is −52° C.

EXAMPLE 9

The synthesis is effected as described in Example 4. Used for the synthesis are 77 g of biphenyl, 265 g of 2-chlorodecane, 4 g of aluminum chloride and 75 ml of decane.

Decane is distilled-off under vacuum of a water-jet pump, the residual pressure being 12 mm Hg.

The following fractions are collected in the vacuum fractionation process:

Fraction I with a boiling temperature of up to 180° C./0.3 mm Hg—15 g;

Fraction II with a boiling point within the range of from 180° to 220° C./0.25 mm Hg—29 g;

Fraction III with a boiling point within the range of from 220° to 250° C./0.25 mm Hg—218 g;

Bottoms with a boiling point above 250° C./0.2 mm Hg 16 g.

The yield of Fraction III (the desired product) is 76% by weight. The iodine number of the desired product is 0.6 to 1.0.

EXAMPLE 10

The synthesis is conducted as per Example 4. To this end, use is made of 77 g (0.5 mole) of biphenyl, 340 g (2.3 moles) of 2-chloroctane, 10 g (0.075 mole) of aluminum chloride and 75 ml of decane.

Decane is distilled off under vacuum. The vacuum of 12 mm Hg is ensured by means of a water-jet pump. The following fractions are thus obtained:

Fraction I with a boiling point of up to 170° C./0.25 mm Hg—23 g;

Fraction II with a boiling point of 170°-220° C./0.25 mm Hg—55 g;

Fraction III with a boiling point of 220°-250° C./0.25 mm Hg—220 g.

Bottoms with a boiling point above 250° C./0.2 mm Hg—17 g.

The yield of Fraction III is equal to 66%. The average molecular weight is 590.

EXAMPLE 11

The synthesis is conducted as per Example 4. To this end, use is made of 77 g (0.5 mole) of biphenyl, 255 g (1.25 mole) of 2-chlorodecane, 4 g (0.03 mole) of aluminum chloride and 75 ml of decane.

Decane is distilled off under vacuum. The vacuum of 12 mm Hg is ensured by means of a water-jet pump. The following fractions are thus obtained:

Fraction I with a boiling point of up to 180° C./0.2 m Hg—17 g;

Fraction II with a boiling point of 180°-220° C./0.2 mm Hg—32 g;

Fraction III with a boiling point of 220°-250° C./0.2 mm Hg—208 g.

The yield of Fraction III is equal to 72%. The properties of the desired product are similar to those described in Example 4.

What is claimed is:

1. A process for producing high-vaccum oils comprising alkylation of condensed and non-condensed aromatic hydrocarbons with compounds selected from the group consisting of normal secondary alkylchlorides containing 8 to 12 carbon atoms, and mixtures of said chlorides; said alkylchlorides having an iodine number of not more than 1, and being taken in a molar ratio to said condensed and non-condensed aromatic hydrocarbons ranging from 2.5:1 to 5:1; conducting the alkylation reaction at a temperature within the range of from 20° to 100° C. in the presence of 2 to 15 mol.% of aluminum chloride based on the amount of the alkylchlorides employed until the evolution of hydrogen chloride ceases, separating the catalyst from the alkylate produced in the reaction, distilling said alkylate under vacuum, collecting the desired fraction with a boiling range of from 220° to 250° C./0.3 mm Hg and recycling the remaining fractions to the alkylation stage.

2. A process as claimed in claim 1, wherein in order to increase the desired product yield, the remaining fraction with a boiling temperature within the range of from 170° to 220° C./0.3 mm Hg is recycled to the alkylation stage.

3. A process as claimed in claim 1, wherein as the condensed aromatic hydrocarbon used is made of naphthalene.

4. A process as claimed in claim 1, wherein as the non-condensed aromatic hydrocarbon use is made of biphenyl.

5. The process of claim 1, wherein said high-vacuum oils have an iodine number varying from about 0.6 to 1.

* * * * *